US009570281B2

(12) United States Patent
Zhang et al.

(10) Patent No.: US 9,570,281 B2
(45) Date of Patent: Feb. 14, 2017

(54) ION GENERATION DEVICE AND ION GENERATION METHOD

(71) Applicant: SHIMADZU CORPORATION, Kyoto (JP)

(72) Inventors: Xiaoqiang Zhang, Shanghai (CN); Wenjian Sun, Shanghai (CN)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/835,526

(22) Filed: Aug. 25, 2015

(65) Prior Publication Data

US 2015/0364313 A1 Dec. 17, 2015

Related U.S. Application Data

(63) Continuation of application No. PCT/CN2014/000176, filed on Feb. 25, 2014.

(30) Foreign Application Priority Data

Feb. 25, 2013 (CN) ..... 2013 1 0059058

(51) Int. Cl.
*H01J 49/06* (2006.01)
*H01J 49/16* (2006.01)
*H01J 49/00* (2006.01)

(52) U.S. Cl.
CPC ..... *H01J 49/065* (2013.01); *H01J 49/0072* (2013.01); *H01J 49/165* (2013.01)

(58) Field of Classification Search
CPC ..... H01J 49/062; H01J 49/063; H01J 49/065; H01J 49/066
See application file for complete search history.

(56) References Cited

U.S. PATENT DOCUMENTS

| | | | | |
|---|---|---|---|---|
| 4,160,161 | A * | 7/1979 | Horton | H01J 49/165 250/281 |
| 5,481,107 | A * | 1/1996 | Takada | G01N 30/728 250/281 |
| 6,730,904 | B1 * | 5/2004 | Wells | H01J 49/062 250/288 |
| 7,671,344 | B2 * | 3/2010 | Tang | H01J 49/066 250/281 |
| 8,507,850 | B2 * | 8/2013 | Whitehouse | H01J 49/04 250/281 |
| 8,658,970 | B2 * | 2/2014 | Kenny | H01J 49/422 250/283 |
| 2015/0206731 | A1 * | 7/2015 | Zhang | H01J 49/065 250/396 R |

* cited by examiner

*Primary Examiner* — Jack Berman
(74) *Attorney, Agent, or Firm* — Tim Tingkang Xia, Esq.; Locke Lord LLP

(57) ABSTRACT

The invention relates to an ion generation device and an ion generation method, and more particularly to a device and a method which generates ions at the low pressure and then said ions can be transferred into the next stage in an off-axis manner. In the invention, ions from electrospray or other types of ion source are generated in the pressure which is lower than atmosphere pressure. A followed ion guide device can then transfer most of said generated ions into next stage in an off-axis manner, while most of neutral noise can be eliminated in this process.

20 Claims, 6 Drawing Sheets

ION GENERATION DEVICE AND ION GENERATION METHOD

CROSS-REFERENCE TO RELATED APPLICATIONS

This application is a continuation application of International Patent Application No. PCT/CN2014/000176, filed Feb. 25, 2014, which itself claims the priority to Chinese Patent Application No. 201310059058.9, filed Feb. 25, 2013 in the State Intellectual Property Office of P.R. China, which are hereby incorporated herein in their entireties by reference.

FIELD OF THE INVENTION

The present invention relates to an ion generation device and an ion generation method.

BACKGROUND OF THE INVENTION

Since electrospray ionization (ESI) technology was invented by John Fenn in 1984, the electrospray ion source has become the most commonly used ion source in the mass spectrometry field due to characteristics of the ESI such as low ionization energy, easy generation of multiple-charged ions, and easy integration with a liquid chromatograph. It is an important topic in the field on how to improve sensitivity of an electrospray ion source region.

The current limiting factors to sensitivity of electrospray mass spectrometry are mainly from the following aspects. 1. The quantity of generated ions is small. The ion generation process involves forming, evaporation, and Coulomb explosion of spray droplets. In the process, more charges on droplets can be obtained by adjusting electrochemical parameters, surface tension, droplet radius and the like. However, the most important limiting factor in the process is whether droplet desolvation can be thoroughly performed to release gaseous ions. 2. A huge ion loss happens in ions' transmission. Currently, almost all the commercial instruments carry out electrospray under the atmospheric pressure or under a pressure close to the atmospheric pressure, whereas a mass analyzer needs to work under a higher vacuum, so a series of vacuum interfaces and ion guide devices are required to enable ions generated by electrospray to get into the analyzer. As an atmospheric pressure vacuum interface (usually a capillary or a sampling cone with a diameter less than 1 mm) must be kept small to maintain the vacuum in the next stage, over 90% of the ions are lost on the vacuum interface. 3. Severe noise interference often occurs. The noise in the electrospray source is complex, which include matrix effects resulting from competition of charges by impurities like salt and sugar in a real sample, and neutral molecule noise caused by solvent molecules or clusters that are not fully removed or background gas impurities and the like. The neutral molecule noise greatly degrades the sensitivity of a mass spectrometer.

To solve the problems that the quantity of generated ions is small and the desolvation is insufficient, a common method is to introduce a desolvation gas with a high flow rate and high temperature to facilitate the droplets' desolvation process, as shown in U.S. Pat. Nos. 6,759,650 and 8,039,795. However, the desolvation gas with a high flow rate leads to high cost, and the high temperature gas may result in evaporation and even boiling of some volatile solvents, or result in thermal dissociation of certain analytes.

To solve the problem of ion loss at the vacuum interface, the electrospray can be run in very low liquid flow rate so called microspray or nanospray, in which the ESI emitter with a small diameter is employed to reduce the spray volume. As a result, the proportion of ions passing through the interface is increased. The capillary or sampling cone with larger diameter is also feasible, along with higher requirement to the pumping capability in the next vacuum stage. U.S. Pat. No. 6,803,565 discloses a method in which the multi-emitter nanospray coupled with multi-capillary interface, and the method is actually a combination of the above two methods. A more effective method is to perform electrospray directly under a low gas pressure. U.S. Pat. Nos. 5,838,002, 6,068,749, and 7,671,344 disclose a device and a method for performing electrospray under a low gas pressure. Particularly in U.S. Pat. No. 7,671,344, an ion guide device "ion funnel" with a large ion acceptance area is employed to enable most of the ions can be transported and focused into the next vacuum stage. However, this method cannot reduce the coming along noise. Although the "ion funnel" improves the transmission efficiency of ions, it also brings more noises. Moreover, as collisions between droplets and gas molecules are reduced under the low pressure, the insufficiency of the desolvation process gets more severe. Fewer ions which are released from the droplets and more noise from those undesolved droplets give a much lower signal to noise ratio in mass spectrum.

To reduce the coming noise from an electrospray ion source, U.S. Pat. No. 6,730,904 and No. US2011/0049357 disclose two ion guide devices to guide ions in so called off-axis manner. Through such kind of devices, ions are deflected in an electric field, and neutral molecules are pumped away by a rotary pump along a straight path, to implement off-axis transportation of the ions and reduce the noise caused by the neutral molecules. In addition to the complex structures themselves, such devices currently only have been coupled with an atmospheric pressure ion source instead of a low pressure electrospray interface. Therefore, the huge ion loss on the vacuum interface still exists on those devices. The possible reason for that is the typical working pressure of those ion guide devices is below 3 torr or even lower if with reasonable voltage application under disclosed geometry size, whereas the typical pressure for stable and sensitive electrospray is above 10 torr, from the experience of the inventor.

To sum up, there is in need of a method to solve the factors that limit the sensitivity of electrospray, thereby achieving a higher sensitivity of the mass spectrometer.

SUMMARY OF THE INVENTION

An object of the present invention is to provide an ion generation device and an ion generation method. The method can reduce the loss of electrospray ions on a vacuum interface, and can also lower impact of neutral noises, so as to improve sensitivity of an electrospray ion source.

In order to accomplish the above objects, the present invention provides an ion generation device, comprising: a chamber, wherein the pressure is lower than the atmosphere pressure; an electrospray ion source, located in said low pressure chamber, and used for generating ions in said chamber; an ion guide device, located in said chamber and at the downstream of said ion source, wherein said ion guide device being divided into at least two electrically insulating parts in the radial direction, wherein an offset voltage being applied between said at least two parts, wherein said generated ions are guided along the direction which deviates from the spray direction under said offset voltage; and an ion outlet port, located at the downstream of said ion guide device, by which the ions being guided out of said chamber, wherein the direction of ions being guided out deviates from the spray direction. The present invention also provides an ion generation method under low pressure, comprising: a step of generating ions by an electrospray ionization source under the pressure which is lower than the atmospheric pressure; and a step of guiding said generated ions to deviate from the spray direction through an ion guide device, wherein an offset voltage being applied on at least two electrically insulating parts in a radial direction of said ion guide device.

Compared with the prior art, the present invention has the following advantages:

1. Compared with the technologies of electrospray under atmosphere pressure and off-axis transportation of ions under low pressure, the present invention can significantly reduce ion loss on the interface between the atmospheric pressure and the vacuum. Most of the ions generated by electro spray can get into the mass spectrometer. Therefore, transmission efficiency of ions can be greatly improved.

2. Compared with the reported technology in low pressure electrospray, the present invention can reduce interference of neutral noise, which mainly comes from undesolved droplets and neutral molecules. As a result, signal-to-noise ratio of the instrument can be improved.

BRIEF DESCRIPTION OF THE DRAWINGS

To make the above objectives, features, and advantages of the present invention comprehensible, exemplary embodiments of the present invention are described in detail below with reference to the accompanying drawings.

DETAILED DESCRIPTION OF THE PREFERRED EMBODIMENTS

Figure 1:
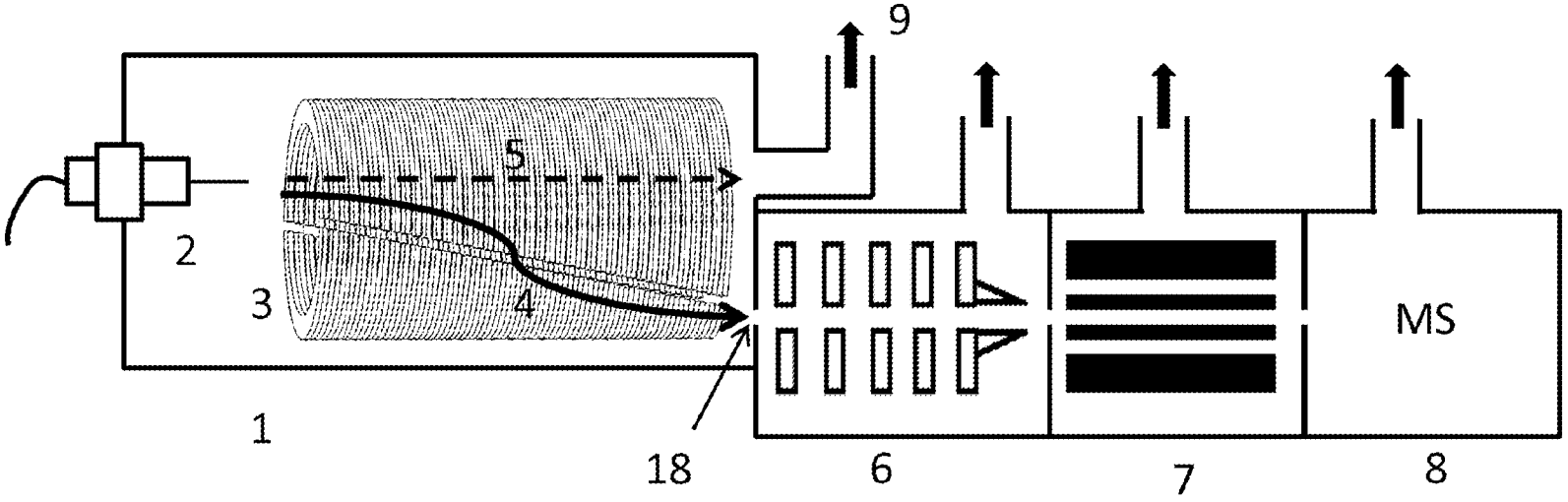
FIG. 1 is a typical schematic view of an ion generation device according to a first embodiment of the present invention.

FIG. 1 shows a typical schematic of an ion generation device according to a first embodiment of the present invention. In the device, a vacuum chamber 1 is disposed, the typical pressure value of the chamber is 1 to 200 torr, and the preferred pressure value is 10 to 30 torr. An electrospray ion source 2 and an ion guide device 3 are disposed in the vacuum chamber. The axis of electrospray 2 is substantially parallel with or overlaps with the central axis of the ion guide device 3 in axial direction. Typically, the ion guide device 3 comprises plurality of stacked ring electrodes which distributed along the central line longitudinally. Radio frequency (RF) voltages of opposite phases are applied on adjacent rings to confine ions in radial direction, and a direct current (DC) voltage gradient is applied in the axial direction to drive the ions to move forward along the axial line. Each ring is formed by two segmented electrodes, a DC offset voltage is applied between the two segmented electrodes, and the offset voltage can drive the ions to deviate from the axial line and move to one side of the ring. In a typical situation, the ratio between the lengths of two segmented electrodes on each ring gradually changes along the axial direction, so that the ions are guided in an off-axis manner in the axial direction and are focused in the radial direction prior to getting into the next vacuum stage. A typical process is that, the electrospray ion source 2 produces charged droplets under low pressure; the charged droplets gradually undergo desolvation to generate charged ions in the flying process; the ions enter the device 3 and be transmitted in an off-axis manner along the direction marked by a reference numeral 4 in FIG. 1; and then through an ion outlet port 18, the ions get into the next stage which contains devices 6 and 7; ions are finally being mass analyzed by the analyzer 8. Those undesolved droplets, or solvent clusters which carries very few charges, or other neutral molecules are pumped away through a vacuum pumping port 9 of the device 3, by a rotary pump outside the chamber 1 along the direction marked by a dashed line 5 in FIG. 1. The device enables a majority of generated ions to get into the mass spectrometer without losing on the atmospheric pressure-vacuum interface. In the meanwhile, accompanying neutral noise can be effectively eliminated. Therefore, the device in the invention can provide the highest sensitivity which may only be achieved in theory in the past.

In this embodiment, the ion guide device 3 is not limited to in the form of stacked-ring. The RF multipole, the quadrupole array ion guide, the wire electrode ion guide, the traveling wave ion guide, and the like may also be used as the ion guide device 3 in the present invention, as long as an offset voltage in radial direction is applied to reduce the noise. The low pressure electrospray ion source 2 is preferably a nanospray ion source. But it is also feasible to use the microspray or higher flow rate spray ion source. The number of the ESI emitter may be one or more, or even a chip with arrays of ESI emitters can be adopted. The geometrical axis of the low pressure electrospray ion source 2 and the axis of ion guide device 3 may be in parallel or overlap, and may form a certain angle at the cost of reducing transmission efficiency. Arranging a repelling or guiding electrode may be necessary in this situation.

In this embodiment, the desolvation efficiency of sprayed droplets under the low pressure is slightly lower than that under the atmospheric pressure. Additional technical means is necessary to further help desolvation. For example, an auxiliary heating gas from the atmospheric pressure can be introduced into the chamber to interact with the ESI plume, with the purpose to facilitate the desolvation process. The direction of rushing gas may be coaxial or form a certain angle with the spray direction. The introduction of gas can also raise the pressure around the tip region of ESI emitter, thereby reducing the probability of electrical breakdown. It is also feasible to introduce a laser beam by irradiating it on the ESI plume, or to use the ultrasonic wave to vibrate the sprayed droplets, or to arrange a heating tube surround the ESI plume, or to heat the entire volume of vacuum chamber, and so on.

In this embodiment, other ion guide device, e.g., multi-stage rod, which works under much lower pressure can be located on the downstream of the device in the invention, with the purpose to guide the ions into a mass analyzer for analysis. Or, other types of analyzer, an ion mobility spectrometer or a spectrum analyzer for example, can be located on the downstream of the device in the invention. A liquid chromatograph or a syringe pump and the like can be located on the upstream of the device in the invention.

Figure 2:
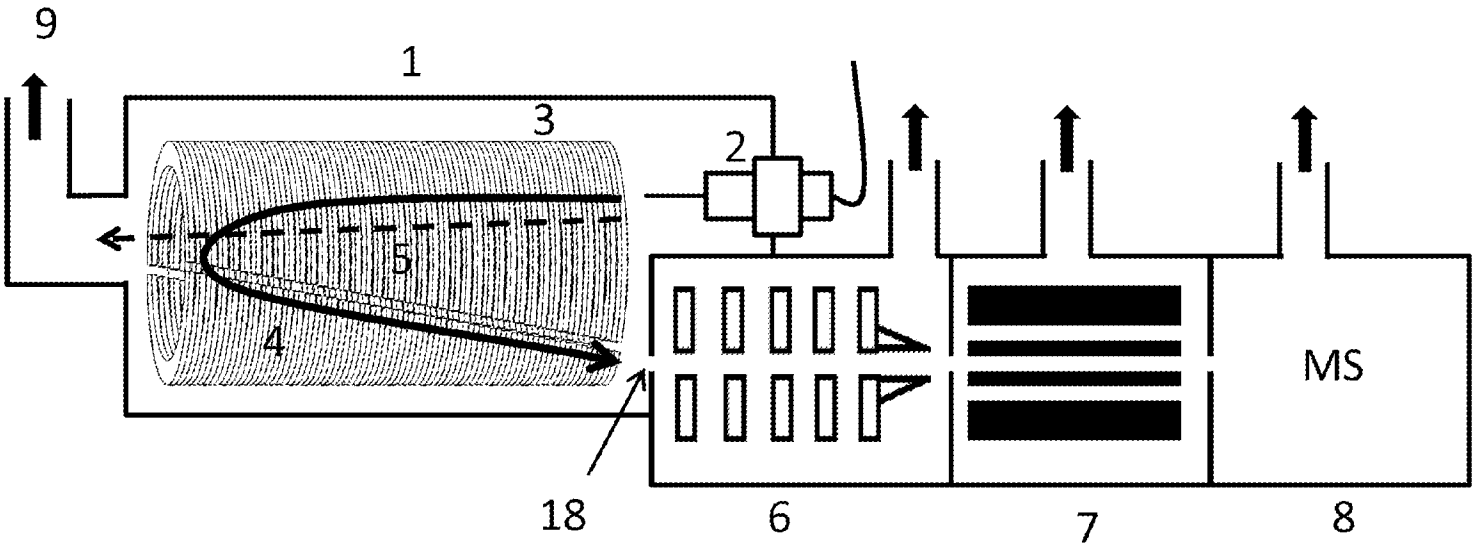
FIG. 2 is a schematic view of a variation embodiment according to the first embodiment of the present invention.

FIG. 2 shows a variation embodiment of the first embodiment. This variation embodiment demonstrates that the ions generated by electrospray can be guided in different forms of off-axis transportation. In FIG. 2, the axial direction of the low pressure electrospray ion source 2 and the direction of axis (that is, potential decreasing directions of the axial lines) in ion guide device 3 are opposite. The positive charged droplets generated by the ion source 2 have a high initial velocity and fly into the device 3 along the opposite direction of axis of device 3. Those droplets undergo desolvation to generate charged ions in the flying process. Then the charged ions can be decelerated gradually by the axial electric field of the device 3 and reverse their flying direction. And then the ions enter the downstream device 6 through the ion outlet port 18 along that marked by the reference numeral 4 in FIG. 2. In the meanwhile, droplets those fail to undergo thorough desolvation or other neutral molecules can be pumped away through the vacuum pumping port 9 along that marked by the dashed line 5 in FIG. 2. The ion drift direction in this variation embodiment changes by 180°, while the neutral noises can only move forward linearly, so that this method can eliminate the noise more thoroughly. The direction of the ions being guiding out from the ion guide device 3 may also be vertical to the axis of the device 3 or form a certain angle, which further reduces the noises and also decreases the footprint of the whole instrument.

Figure 3:
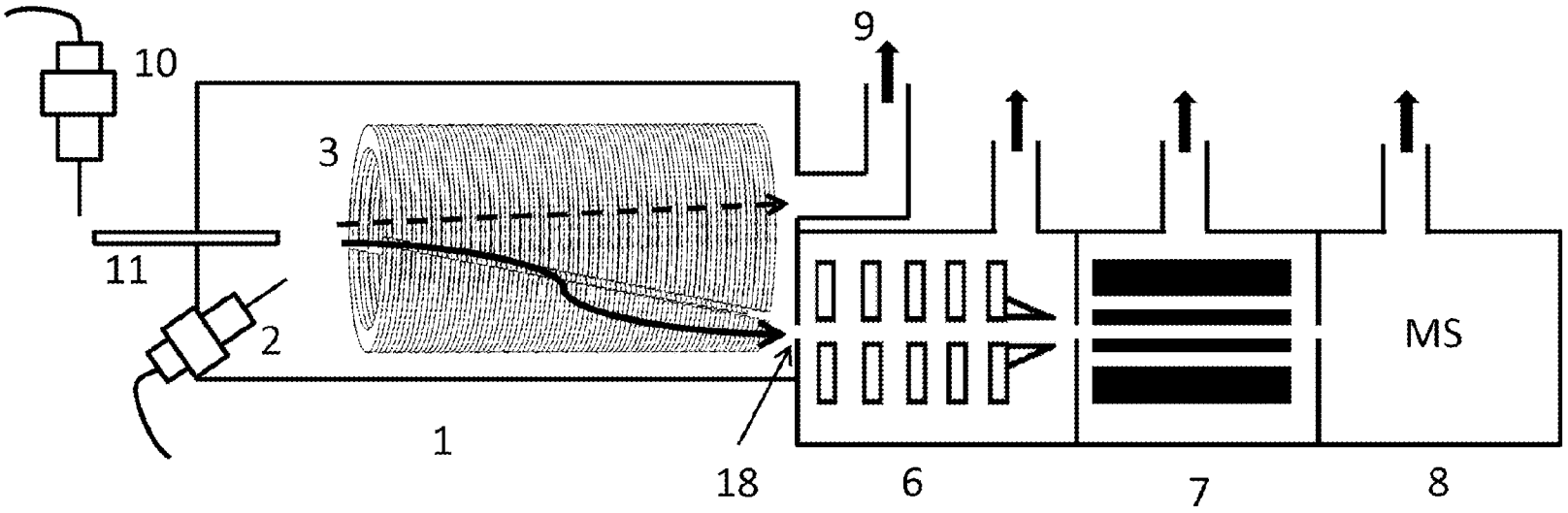
FIG. 3 is a typical schematic view of an ion generation device according to a second embodiment of the present invention.

FIG. 3 shows a second embodiment of the device and the method of the present invention. In this embodiment, an atmospheric pressure electrospray ion source 10 is further adopted, and charged droplets and ions generated by the atmospheric pressure electrospray ion source 10 pass through an atmospheric pressure-vacuum interface 11 (a heated capillary herein) and enter the ion guide device 3 along with the charged droplets and ions generated by the low pressure electrospray ion source 2, to perform off-axis transmission to enter the downstream device 6. The atmospheric pressure-vacuum interface 11 may bring about more severe neutral noise. However, in the presence of the ion guide device 3 and the vacuum pumping port 9, neutral noise rushing into the chamber 1 from the atmospheric pressure can be effectively eliminated. This embodiment can also be used in mass calibration in a high resolution mass spectrometer by an internal standard method, such as in a time-of-flight mass spectrometer. In this case, the low pressure electrospray ion source 2 can serve as an ion source of internal standard ions, while the atmospheric pressure electrospray ion source 10 can serve as an ion source of analyte ions. Compared with conventional mass calibration apparatus by an atmospheric pressure dual-spray source, this method has the following two advantages. 1. The electric field interference between sources is avoided, so that two spray sources can work stably, while this problem used to be serious on the atmospheric pressure dual-spray source. 2. The low pressure electrospray ion source 2 may spray at a low flowrate (for example, nanospray is commanded). Since there is no ion loss, signals are equivalent to that of spray at a conventional flow rate (hundreds of microliters for example) under the atmospheric pressure, which greatly reduces the required quantity of the expensive internal standard substances.

In this embodiment, the device may not perform mass calibration, and only serves as a dual-pressure ionization source which both used for the analyte. Time sequence can be controlled to get two ion sources work simultaneously or independently. The atmospheric pressure electrospray ion source 10 may also be another type of ambient ion source, such as, an atmospheric pressure chemical ionization source, an atmospheric pressure photon ionization source, or an ambient direct analysis ionization source. The atmospheric pressure electrospray ion source 10 may not perform ionization, but only generate gaseous molecules of the analyte. For example, laser desorption can be performed on the sample to generate gaseous molecules, and the gaseous molecules enter the vacuum chamber 1 and then are post-ionized by the low pressure electrospray ion source 2. The atmospheric pressure-vacuum interface 11 may be in various forms such as a capillary or a sampling cone, and may even be an atmospheric pressure lens. The interface may also serve as a desolvation device of the low pressure electrospray ion source 2.

Figure 4:
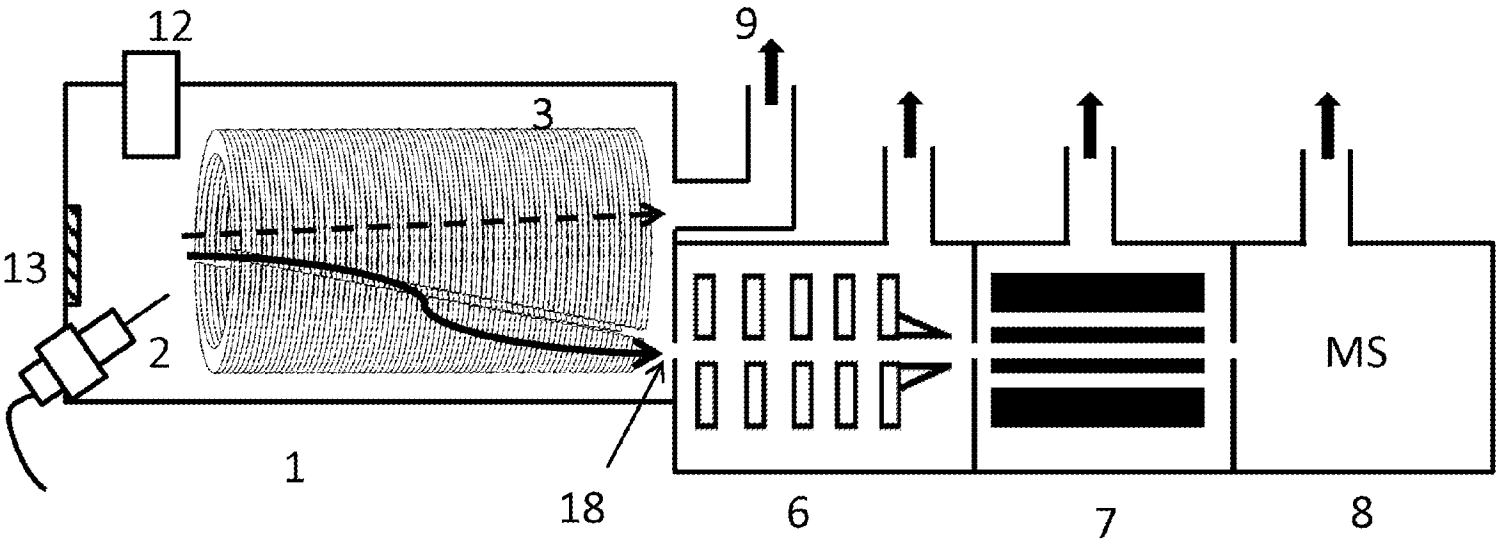
FIG. 4 is a schematic view of a variation embodiment according to the second embodiment of the present invention.

FIG. 4 shows a first variation embodiment of the second embodiment. This variation embodiment demonstrates that the low pressure electrospray ion source 2 can not only be integrated with an atmospheric pressure ion source, but also be integrated with a low pressure ion source 12. The low pressure ion source 12 may be any types of the ion source, for example, an electrospray source, a matrix-assisted laser desorption ionization source, a chemical ionization source, a vacuum photon ionization source, or an electron ionization source. To achieve better configuration of the low pressure electrospray ion source 2 and the low pressure ion source 12, a repelling electrode 13 or other guide electrodes can be added. The low pressure ion source 12 may not be placed in the same vacuum chamber with the low pressure electrospray ion source 2. Typically, the low pressure ion source 12 may be placed in the vacuum chamber of the device 6. In this situation, ion source 2 and ion source 12 are usually in different types. For example, ion source 2 is a low pressure electrospray ion source, while ion source 12 is a low pressure electron ionization source which works under a different pressure from ion source 2. In the case of tandem mass spectrometry, the low pressure ion source 12 may be placed on the downstream of the first mass analyzer. In this case, ions generated by the low pressure ion source 12 enter a collision cell of the tandem mass spectrometry in a reverse direction, and collide with the ions generated by the low pressure electrospray ion source 2 which entering the collision cell in a forward direction, so as to carry out chemical reaction or generate daughter ions for tandem analysis.

Figure 5:
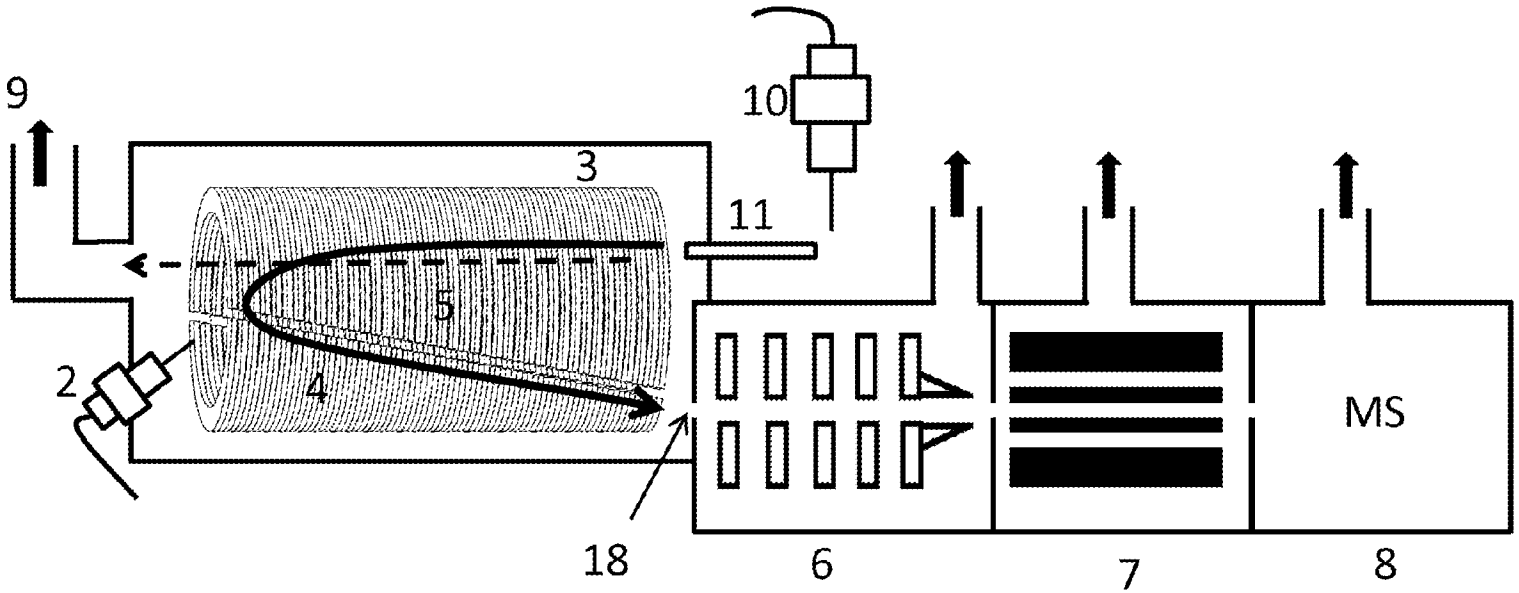
FIG. 5 is a schematic view of the variation embodiments according to the embodiments shown in FIG. 1 to FIG. 4.

FIG. 5 shows a variation embodiment of the above embodiments. In this variation embodiment, the ions generated by the atmospheric pressure ion source 10 enter the ion guide device 3 through the atmospheric pressure-vacuum interface 11 in a direction opposite to the axial direction of the device 3, and are decelerated and deflected in a reverse direction before entering the downstream device 6 through the ion guide device 3 together with the ions generated by the low pressure electrospray ion source 2. This variation embodiment having the advantages of the ion generation device in the above embodiments, for example, it can reduce the neutral noise to a maximum extent.

Figure 6:
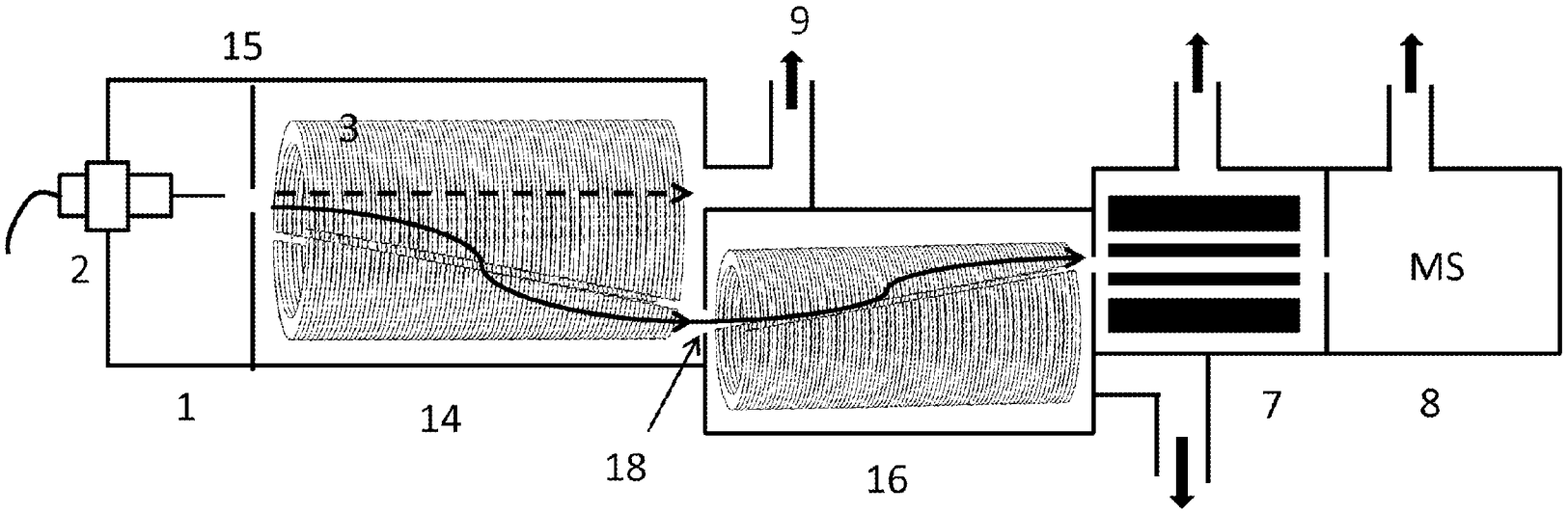
FIG. 6 is a typical schematic view of an ion generation device according to a third embodiment of the present invention.

FIG. 6 shows a third embodiment of the ion generation device and the ion generation method in the present invention. In this embodiment, a vacuum interface 15 is added between the low pressure electrospray ion source 2 and the ion guide device 3, and the interface may be a sampling cone, a capillary, a high pressure ion lens and the like. The diameter of an outlet port of the vacuum interface is generally smaller than 2 mm in order to obtain a good focusing effect. The low pressure electrospray ion source 2 usually works under sub-ambient pressure, for example, in a range of 100 to 300 torr, so that the electrospray desolvation process is more thoroughly performed, and a higher electrospray flow rate can be used to get high throughput analysis. The ion guide device 3 is placed in another vacuum chamber 14, and the pressure in the vacuum chamber 14 may be in a range of 10 to 30 torr. Another ion guide device 16 may be added to the downstream of the ion guide device 3, and has an off-axis guide structure like that of the ion guide device 3. The pressure of the ion guide device 16 is in a range of 1 to 3 torr. In this case, the ion beam can be continuously "deflected" twice, and neutral noise introduced by the pressure difference between the vacuum chamber 14 and the ion guide device 16 are reduced, so as to further improve the signal-to-noise ratio of mass spectrometer.

What is claimed is:

1. An ion generation device, comprising:

a chamber, wherein the pressure is lower than the atmosphere pressure;

an electrospray ion source, located in said low pressure chamber, and used for generating ions in said chamber;

an ion guide device, located in said chamber and at the downstream of said ion source, wherein said ion guide device being divided into at least two electrically insulated parts in the radial direction, wherein an offset voltage being applied between said at least two parts, wherein said generated ions are guided along the direction which deviates from the spray direction under said offset voltage; and an ion outlet port, located at the downstream of said ion guide device, by which the ions being guided out of said chamber, wherein the direction of ions being guided out deviates from the spray direction, wherein the spray direction is substantially opposite to the ion outlet direction.

2. The ion generation device as in claim 1, further comprising a gas pumping port, located on one end of said chamber and being different from said ion outlet port, and used for pumping away at least part of neutral noise components through said pumping port.

3. The ion generation device as in claim 1, wherein the offset voltage is a DC voltage, or an AC voltage, or a combination of the two.

4. The ion generation device as in claim 1, wherein the ion guide device guides the ions axially and focuses the ions near the ion outlet port.

5. The ion generation device as in claim 1, wherein the ion guide device comprises a plurality of stacked ring electrodes which are distributed along a central line longitudinally, wherein each ring comprises at least two segmented electrodes.

6. The ion generation device as in claim 5, wherein a DC voltage is applied between said segmented electrodes on the same ring.

7. The ion generation device as in claim 1, wherein the ion guide device comprises an array of multipole rods which distributed along a central line longitudinally.

8. The ion generation device as in claim 1, further comprising one or more capillaries used as the interface between said low pressure chamber and the outside region which is under near atmosphere pressure.

9. The ion generation device as in claim 8, further comprising one or more electrospray ion sources located in said region under near atmosphere pressure.

10. The ion generation device as in claim 1, wherein said electrospray ion source under low pressure and said electrospray ion source under near atmosphere pressure work simultaneously.

11. The ion generation device as in claim 1, wherein the electrospray ion source is a nanospray ion source.

12. The ion generation device as in claim 1, further comprising a vacuum interface, wherein the vacuum interface enables said electrospray ion source and said ion guide device to be under different pressures.

13. The ion generation device as in claim 1, further comprising another ionization source which is not an electrospray ion source.

14. The ion generation device as in claim 1, further comprising an ion drift cell which is located at the downstream of said ion outlet port for ion mobility analysis.

15. An ion generation method under low pressure, comprising:

a step of generating ions by an electrospray ionization source under the pressure which is lower than the atmospheric pressure; and a step of guiding said generated ions to deviate from the spray direction through an ion guide device, wherein an offset voltage being applied on at least two electrically insulated parts in a radial direction of said ion guide device, wherein said ion guide device comprises a plurality of stacked ring electrodes which are distributed along a central line longitudinally, wherein each ring comprises at least two segmented electrodes.

16. The ion generation method as in claim 15, wherein at least part of neutral noise components under said low pressure are pumped away through a gas pumping port.

17. The ion generation method as in claim 15, wherein said ions are guided along a curved axis.

18. The ion generation method as in claim 15, wherein said generated ions pass through a vacuum interface firstly and then are guided by said ion guide device, wherein the electrospray process and the ion guiding process are under different pressures.

19. An ion generation device, comprising:

a chamber, wherein the pressure is lower than the atmosphere pressure;

an electrospray ion source, located in said low pressure chamber, and used for generating ions in said chamber;

an ion guide device, located in said chamber and at the downstream of said ion source, wherein said ion guide device being divided into at least two electrically insulated parts in the radial direction, wherein an offset voltage being applied between said at least two parts, wherein said generated ions are guided along the direction which deviates from the spray direction under said offset voltage; and an ion outlet port, located at the downstream of said ion guide device, by which the ions being guided out of said chamber, wherein the direction of ions being guided out deviates from the spray direction, wherein the ion guide device comprises a plurality of stacked ring electrodes which are distributed along a central line longitudinally, wherein each ring comprises at least two segmented electrodes.

20. An ion generation method under low pressure, comprising:

a step of generating ions by an electrospray ionization source under the pressure which is lower than the atmospheric pressure; and a step of guiding said generated ions to deviate from the spray direction through an ion guide device, wherein an offset voltage being applied on at least two electrically insulated parts in a radial direction of said ion guide device, wherein an ion outlet port is located at the downstream of said ion guide device; and wherein the spray direction is substantially opposite to the ion outlet direction.

* * * * *